United States Patent [19]

Mitter

[11] 4,103,614

[45] * Aug. 1, 1978

[54] SCREEN PRINTING MACHINE WITH RECIPROCATING ENDLESS PRINTING SCREEN

[76] Inventor: Mathias Mitter, Geschaftsfuhrer Falkenstrasse 57, 4815 Schloss Holte, Germany

[ * ] Notice: The portion of the term of this patent subsequent to Aug. 1, 1995, has been disclaimed.

[21] Appl. No.: 726,877

[22] Filed: Sep. 27, 1976

[30] Foreign Application Priority Data

Sep. 29, 1975 [DE] Fed. Rep. of Germany ..... 2543419

[51] Int. Cl.[2] ..... B41F 15/10; B41F 15/38; B41F 15/40

[52] U.S. Cl. ..... 101/115; 68/200; 101/116; 101/119; 101/122; 101/128.1; 118/213; 118/242

[58] Field of Search ..... 101/114, 115, 116, 119, 101/120, 127.1, 128.1, 129, 172, 122, 211; 118/213, 240, 242; 68/200

[56] References Cited

U.S. PATENT DOCUMENTS

| | | | |
|---|---|---|---|
| 2,800,075 | 7/1957 | Rose | 101/115 |
| 3,589,283 | 6/1971 | Childress | 101/115 |
| 3,886,861 | 6/1975 | Anselrode | 101/120 X |
| 3,892,176 | 7/1975 | Van der Winden | 101/116 |
| 3,892,177 | 7/1975 | Giani | 101/127.1 X |

FOREIGN PATENT DOCUMENTS

| | | | |
|---|---|---|---|
| 2,309,300 | 9/1973 | Fed. Rep. of Germany | 101/119 |

*Primary Examiner*—Ronald E. Suter
*Attorney, Agent, or Firm*—Michael J. Striker

[57] ABSTRACT

An endless printing screen of generally annular configuration is supported in end bearings. A tubular carrier extends through the space surrounded by the screen and defines with the screen an annular clearance which is subdivided into two or more axially successive chambers. An arrangement of tubes admits printing medium through the carrier into the chambers so that it can pass through the screen to print onto a web beneath the screen. Devices are provided for reciprocating the endless screen and the carrier.

33 Claims, 15 Drawing Figures

Fig.7
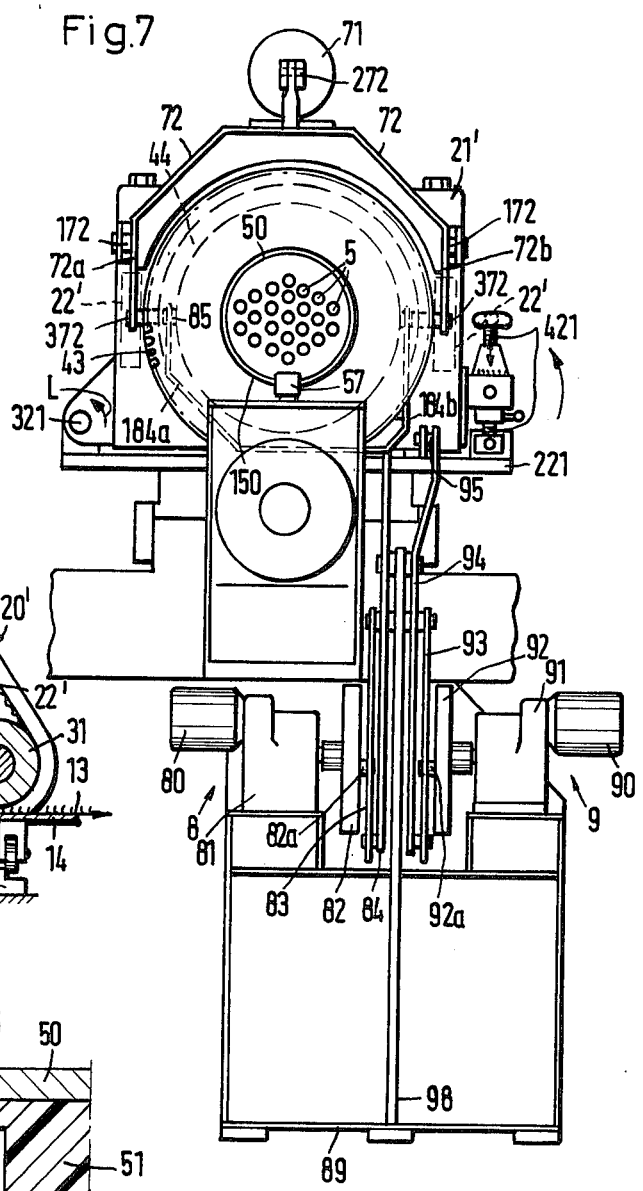
Fig.8
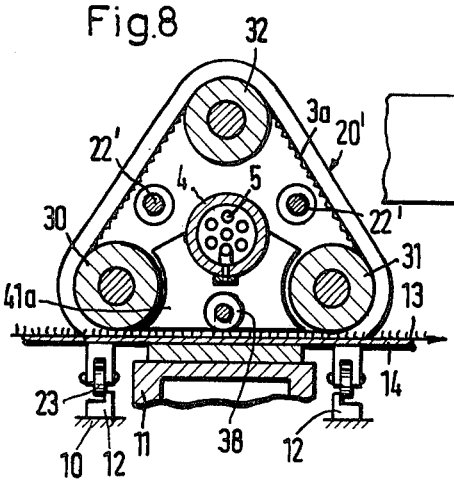
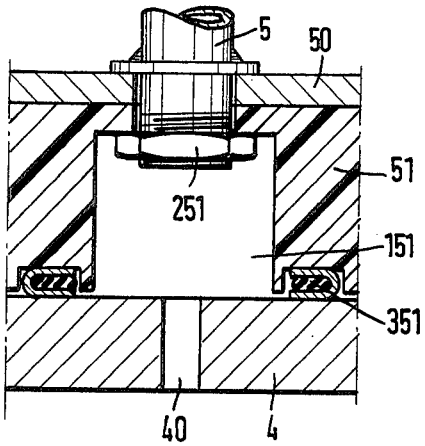
Fig.6

SCREEN PRINTING MACHINE WITH RECIPROCATING ENDLESS PRINTING SCREEN

BACKGROUND OF THE INVENTION

The present invention relates to a screen printing machine of the type utilizing an endless travelling printing screen.

Screen printing machines are either of the type having a flat or planar printing screen, or of the type having an endless travelling printing screen. The latter type comes in two basic varieties, one wherein the printing screen is tubular and the other wherein the printing screen is an endless belt which is trained about a plurality of rollers, usually three rollers which are arranged at the corners of a triangle. In either case, the printing screen is of generally annular configuration.

Screen printing machines of the type having an endless travelling printing screen may be provided with one or more printing stations at each of which one of these printing screens is provided. If two or more such stations are utilized, the machine is suitable for multi-color printing. Usually, the first station (as seen in the direction of workpiece travel), prints the lightest color of the pattern, and succeeding stations print successively darker colors of the pattern. The workpiece web, such as a textile web, a carpet web or the like, is supplied beneath the printing screen, in some instances on a printing blanket which travels beneath the printing screen relative to the same and supports the web. At each printing station a printing medium, for example printing ink, ink paste or the like, is admitted into the interior of the space surrounded by the endless printing screen and is then usually squeezed by means of a squeegee or the like, through the perforations of the printing screen and onto the underlying workpiece web. The perforations of the screen which have been left permeable to the printing medium — other perforations having been made impermeable — produce the desired printing pattern.

The disadvantage of the prior-art printing machines is that the pattern is repeated again and again on the workpiece, i.e. the pattern is repeated in a constantly recurring uniform sequence which can be changed only by replacing the printing screen with another printing screen having a different pattern and/or a different repeat.

SUMMARY OF THE INVENTION

It is an object of the present invention to provide an improved screen printing machine which avoids this disadvantage.

More particularly, it is an object of the invention to provide such a screen printing machine which makes it possible to vary the patterning, i.e. the application of the pattern to a workpiece web, within a very substantial range of possibilities and to also apply two or more different colors simultaneously to the workpiece.

In keeping with these objects, and with others which will become apparent hereafter, one feature of the invention resides in a screen printing machine which, briefly stated, comprises an endless printing screen having an outer surface and a corresponding inner surface; means mounting said printing screen for advancement in a path in which successive portions of said outer surface become juxtaposed with a web travelling past said outer surface; an elongated carrier extending through the space surrounded by said screen transversely of the path of travel of said web and defining with said inner surface an annular clearance; at least one partition on said carrier, extending across said clearance at least opposite said web and subdividing said clearance into two successive axial chambers; and means for admitting flowable printing medium via said carrier into said chambers from where the printing medium passes through the screen so as to print on said web.

The novel machine according to the present invention makes it possible, for the very first time, to make the printing screen wider than the web to be printed and to reciprocate the screen transversely of the path of advancement of the web through greater or lesser distances — which may also be continuously varied, if desired — so as to constantly offset the pattern being printed with respect to the pattern which has just been printed immediately downstream or the pattern which will be printed immediately upstream. If two or more printing stations are used, the reciprocation of all stations may be identical, or else the screens at successive stations may reciprocate in mutually opposite directions during each stroke or the reciprocation of successive printing stations may vary completely, in order to produce any type of desired pattern.

Also, the novel machine makes it possible to print a web with two or more colors simultaneously; in such printing and during the reciprocation, the proportion of one color in the overall pattern increases or decreases reciprocally to the proportion of the other color, if only two colors are used. The color areas of the respective colors become alternately offset towards one or the other side of the web.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 6 is an enlarged-scale fragmentary sectional detail view;

FIG. 7 is a view of the machine in FIG. 1, seen in the direction of the arrow VII of FIG. 1;

FIG. 8 is a somewhat diagrammatic fragmentary cross-section through a printing station of a different type of screen printing machine;

DESCRIPTION OF THE PREFERRED EMBODIMENTS

Figure 1:
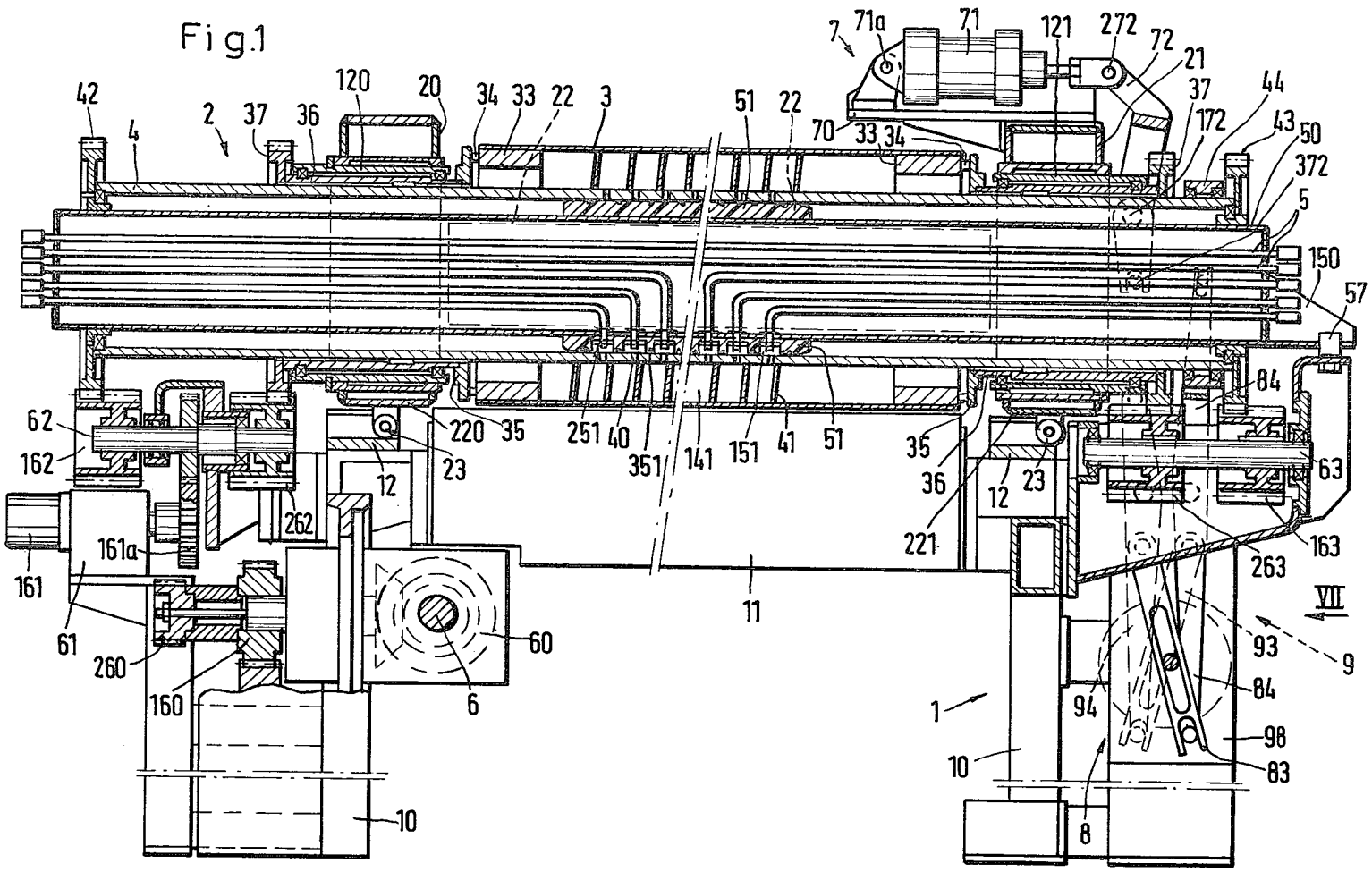
FIG. 1 is a fragmentary vertical axial section through a printing station of a screen printing machine embodying the invention.

Before discussing the individual embodiments in detail it should be understood that with the exception of specifically stated items, the embodiments disclosed herein utilize the same basic elements which will, therefore, be identified throughout the drawing with identical reference numerals.

Referring firstly to the embodiment in FIGS. 1, 2 and 4–7, it will be seen that the screen printing machine according to the present invention as illustrated in these embodiments has a frame 1 which is provided in the area of each printing station (only one shown) with a printing-medium applying device 2. In the region of each printing station the frame 1 is provided with upright supports 10 which are connected with one another by counter pressure beams 11. A printing blanket (not shown) may pass over the counter pressure beam 11 on top thereof, and may carry on its upper surface the workpiece web to be printed. It is emphasized that the printing blanket and workpiece web are shown only in the embodiment of FIG. 8 where they are identified with reference numerals 14 and 13, respectively. However, their presence is equally applicable to all of the other embodiments.

Mounted above the counter pressure beam 11 at the respective printing station is a printing screen 3 which in this first embodiment is of the tubular type, i.e. it is endless and of tubular shape. Mounted on the upright supports 10 are two end bearing units 20 and 21, respectively. The unit 20 is associated with the left-hand end of the tubular printing screen 3 and the unit 21 with the right-hand end thereof. The units 20 and 21 serve to mount the printing screen 3 for rotation about a generally horizontal axis. For this purpose the opposite axial ends of the tubular printing screen 3 have set into them and secured to them respective end rings 33 which are connected via connecting pins 34 with annular support plates 35 which in turn are rigidly connected with bearing sleeves 36. These are rotatably received in journalling sleeves 120 and 121, of which the sleeve 120 is mounted in the end bearing unit 20 and the sleeve 121 is mounted in the end bearing unit 21. The axially outer ends of the sleeves 36 are provided with gears 37 by means of which the printing screen 3 is to be driven in rotation, as will be discussed subsequently. The screen 3 is driven at both of its axial ends in the illustrated embodiment; however it should be understood that if it is desired — for example if the screen 3 is sufficiently strongly tensioned in axial direction thereof so as to be able to withstand the twisting forces resulting from the application of driving torque at only one end — it can be driven at one one of its axial ends.

The embodiment of FIGS. 1, 2 and 5–7 shows a drive for rotating the printing screen 3. This drive comprises a main machine drive shaft 6 which may extend the length of a machine having a plurality of printing stations, and which is associated at each printing station (illustrated by way of example for the one shown in FIG. 1) with an angle drive 60. The main drive shaft 6 is rotated in any conventional manner by an appropriate prime mover and transmits rotation to the angle drive 60 which in turn rotates gears 160 and 260. The gear 260 transmits motion to a variable drive unit 61, for example to an adjustable differential drive having a control motor 161. Such drives are well known per se and are sold by PIV "Werner Reimers K6 Bad" Homburg, BRD.

The drive unit 61 in turn rotates via gear 161*a*, the illustrated gear train 62 having gears 162 and 262; the gear 262 meshes with the gear 37 at the left-hand end of the printing station so as to drive the left-hand end of the printing screen 3. The gear 162 meshes with a gear 42 which is mounted on the left-hand end of a tubular carrier 4 but extends through the end bearing units 20, 21 and through the screen 3, defining an annular clearance with the latter. The carrier 4, which will be described subsequently in more detail, serves the purpose — insofar as motion tranmission is concerned — of transmitting motion to the right-hand end of the printing screen 3 so as to drive the screen at the right-hand end also, in addition to the drive applied to it at the left-hand end. For this purpose the right-hand end of the carrier 4 is provided with a gear 43 which meshes with a gear train 63 having gears 163 and 263 which are mounted on a common shaft. Gear 263 rotates the gear 37 at the right-hand end of the tubular printing screen 3 so that when the gear 263 is driven in rotation by transmission of motion from gear 43 to gear 163, it in turn rotates the gear 37 and thus transmits motion to the right-hand end of the printing screen 3.

The application of torque to both axial ends of the printing screen 3 is advisable, but must be as identical as possible at both ends, since the printing screen 3 is essentially a rather delicate structure composed of extremely thin stainless steel foil or the like, and would become damaged if differential torque were to be applied to its opposite axial ends. The speed of rotation of the screen 3 may, incidentally, be varied by replacing appropriate gears so as to change the gear ratios.

The end bearing units 20 and 21 are connected with one another by traverse members 22 of which two or more are provided, so as to form a rigid unit. The end bearing units 20 and 21 have base plates 220 and 221, respectively, which are provided with rollers, wheels, glides or the like 23 that engage in and move along rail sections 12 provided on the uprights 10. Thus, the rigid unit composed of the end bearing units 20, 21 and the traverse members 22 can reciprocate in the axial direction of the screen 3, i.e. transversely of the path of movement of the workpiece web to be printed, which path of movement is normal to the plane of FIG. 1. It will be noted that the axial length of the gears 162, 163, 262 and 263 is substantially greater than the axial length of the gears 42, 43, 37 with which they mesh; this is to assure that despite axial reciprocation of the aforementioned units, these gears will remain in mesh throughout. It should be noted, however, that the device for supplying and applying printing medium need not be constructed in the manner illustrated and to be described subsequently, which manner is the reason for making the gears 162 and 163 of a greater axial length than their meshing gears; it would be possible to construct the printing medium applicating device as a simple squeegee roller or the like, or a doctor-blade type of squeegee, and this would not detract from the advantages obtained by axially reciprocating the screen 3.

However, the particular construction illustrated in FIGS. 1, 2 and 5–7 has particular advantages in conjunction with the axial reciprocation of the screen 3.

The construction of the printing medium applicating device 2 in the illustrated embodiment is such that in the interior of the hollow carrier 4 which is driven in rotation, there is located an inner tube 50 which extends through the carrier 4 and defines with the same an annular space. The carrier 4 carries a plurality of partitions 41 which extend across the clearance defined between the carrier 4 and the interior surface of the printing screen 3 and form in this clearance at least two — as illustrated, however, a plurality — of printing medium chambers 141 into which printing medium is admitted. Partitions 41 may be flat annular members, or they may be corrugated or otherwise be non-planar. They may be arranged normal to the axis of carrier 4 or, as illustrated, they may be inclined. Any of these positions may be assumed by partitions 41 of whatever shape. A plurality of printing medium tubes 5 extends into the interior of the inner tube 50 through the opposite axial ends thereof and the free ends of these tubes 5 extend through the wall of the inner tube 50 and into chambers 151 which are formed in the circumferential wall of a spacing sleeve 51 which is preferably of synthetic plastic material — e.g. pvc, polyethylene or the like — with each of which one of the tubes 5 communicates and wherein the free end of the respective tube is secured by means of a nut 251. Each of the compartments or chambers 151 in turn communicates with an opening 40 formed in the circumferential wall of the tubular carrier 4 which opening in turn communicates with a respective one of the chambers 141. Different-colored printing media may be applied into each of the chambers 141, if desired. It is important that at least in the lower part of the clearance surrounding the carrier 4 the edge portions of partitions 41 be shaped in conformance with the interior contour of screen 3.

In FIG. 1 I have shown annular partitions 41. These, or any of the ones in the other embodiments, have no supporting function at all; they only serve to bound the chambers 141. Of course, a single partition 41 would already suffice to permit two-color printing; however, it is preferable to provide a plurality of partitions 41 and thus a plurality of chambers 141, since this permits printing at one and the same station with as many colors as there are chambers 141. If the partitions are stationary, each chamber 141 produces a strip of color on the web advancing through the printing station. Of course, within the color strip a pattern may be provided in accordance with the patterning of screen 3, i.e. if the screen is patterned.

FIG. 1 also shows a tensioning device 7 for axially tensioning the printing screen 3. This tensioning device 7 is mounted on one of the end gearing units; in the illustrated embodiment this is end bearing unit 21 which carries a console 70 on which a fluid-operated cylinder-and-piston unit 71 is pivotally mounted at 71*a*. The piston rod of the unit 71 is articulated at 272 to a double-armed lever 72 which has two end portions 72*a* and 72*b* and is thus of fork-like configuration (compare FIG. 7). The lever 72 is pivoted on a pivot 172 secured in the unit 21 and each of the end portions 72*a* and 72*b* is slotted and engages in the respective slot a pin 372 (see FIG. 7) which pins are mounted diametrally opposite one another on the sleeve 121. Unlike the sleeve 120 at the left-hand side of FIG. 1, the sleeve 121 is axially shiftable. The gear 37 and the gear 263 are so constructed in their relative transmission ratio, that the necessary tensioning movement of the screen 3 can be obtained without any difficulty by operation of the cylinder-and-piston unit 71.

Figure 2:
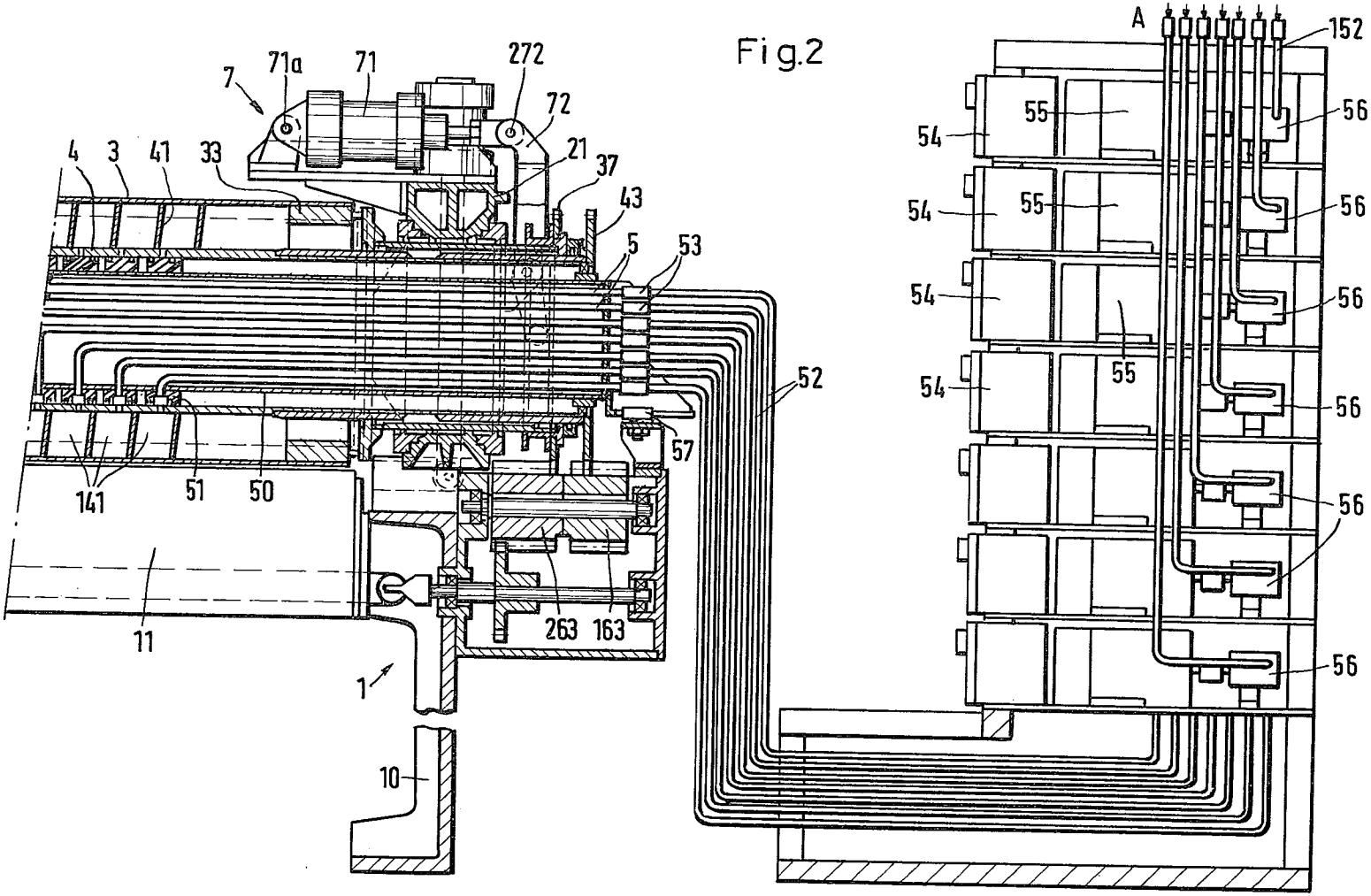
FIG. 2 is a fragmentary vertical section similar to FIG. 1, but illustrating the supply for the printing medium.

FIG. 2 shows that the axially outer ends of the printing-medium tubes 5 (only those at the right-hand end of the machine are shown in FIG. 2) communicate with flexible supply conduits 52 — e.g. hoses or the like — with which they are connected by means of quick-release couplings 53 which are known per se.* The purpose of making the conduits 52 flexible is to permit them to move to-and-fro when the entire unit composed of the end bearing units 20, 21, the screen 3 and the traverse members 22, reciprocates from left to right and vice versa.

*and are sold for ex. under the trademark "Nito" by Schlufer GmbH, Bad Liebenzell, BRD.

The conduits 52 extend to a printing-medium supply unit which comprises for each of the conduits 52 a flow regulator 54 of known construction with a C.C. motor driving the pump, the C.C. motor being sold for ex. by Reliance Rochester, N.Y., U.S.A. which is associated with a respective DC motor that drives in turn a respective pump 56 for printing medium. The suction intakes 152 of the pumps 56 communicate with printing-medium supply containers (not illustrated) from which they draw the printing medium in the direction of the arrows A.

Thus, each of the medium chambers 141 defined between two axially consecutive ones of the partitions 41 receives from an associated pump 56 a precisely predetermined — and adjustable — quantity of printing ink, printing paste or other printing medium. Additional control devices acting upon the flow regulators 54, may also be provided and are known. Of course, the inner tube 50 does not rotate, although it reciprocates with the arrangement as described before. To prevent the inner tube 50 from rotating it is formed at one of its axial ends, i.e. in the illustrated embodiment at the right-hand axial end, with an extension or projection 150 which may be formed with an axial slot into which there extends an anti-rotation member 57 that is mounted on a part of the machine frame 1.

Figure 3:
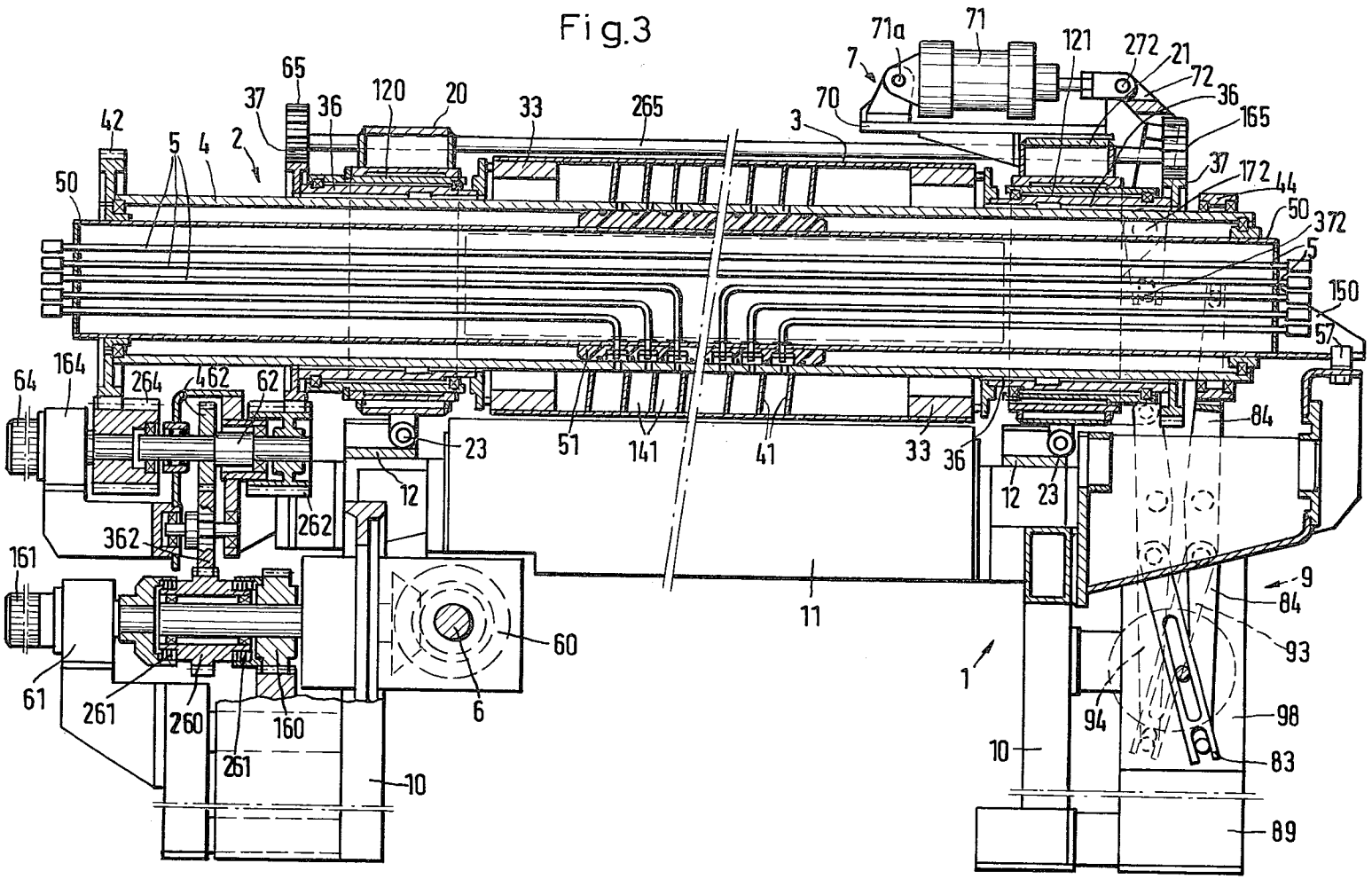
FIG. 3 is a view similar to FIG. 1, but of a further embodiment of the invention.

The embodiment in FIG. 3, which in other ways corresponds to the one in FIG. 1, is provided with a separate drive for the carrier 4. This separate drive comprises a motor 64 which drives a variable gear drive 164, such as a differential gear, for example are sold by "PIV" W. Reimers KG, Bad Homburg, BRD which in turn rotates a gear 264 that meshes with the gear 42. The opposite axial end of the carrier 4 is rotatably journalled within the sleeve 36. In this embodiment, as in the preceding one, the printing screen 3 is again driven from the main drive shaft 6 via the angle drive 60 and the gears 160 and 260. The gear 260 drives via gears 362 and 462 the gear 262 which in turn meshes with the drive gear 37 for the printing screen 3. Torque is transmitted to the right-hand end of the printing screen 3, i.e. the end remote from the end at which the main drive is located which is supplied via the main drive shaft 6, by means of gears 65 and 165 which mesh with the gears 37 at the opposite axial ends of the printing screen 3 and which are coupled for joint rotation by a shaft 265. Thus, when the gear 65 is rotated by its associated gears 37, it turns the shaft 265 which in turn rotates the gear 165 that transmits rotation to the right-hand end gear 37 and thus supplies torque to the right-hand end of the printing screen 3.

Due to the presence of the two motors 64 and 161 the rotational speeds for the carrier 4 and the printing screen 3 can be freely selected at will, each independently of the other. By means of a transfer clutch 261 as sold for example by Stromag GmbH, Vnna BRD the drive of the printing screen 3 can selectively be made proportional to the speed of movement of the workpiece web (not shown) or by means of the transmission 61 it can be made independent of any other factor.

Figure 4:
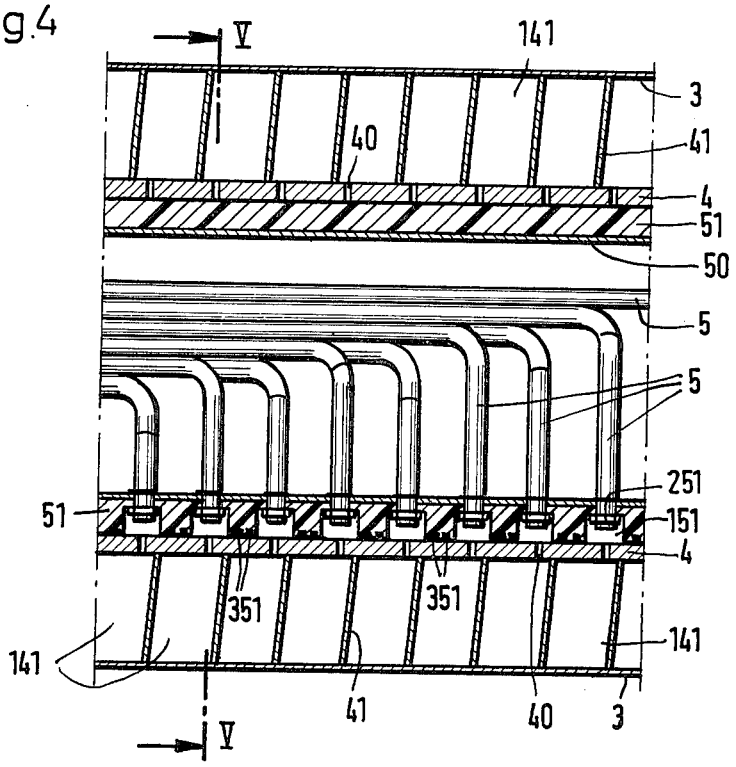
FIG. 4 is a fragmentary vertical section through a printing screen and associated components of the machine according to the present invention.
Figure 5:
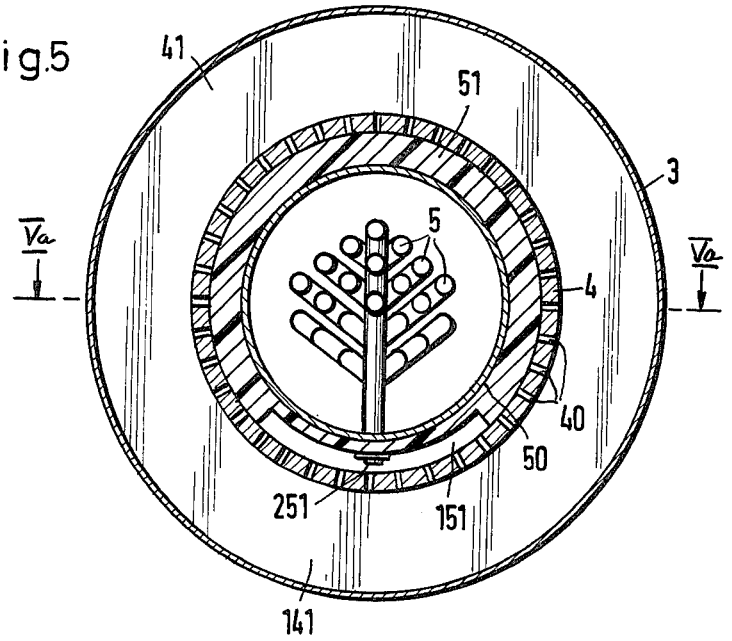
FIG. 5 is a section taken on line V—V of FIG. 4.
Figure 5A:
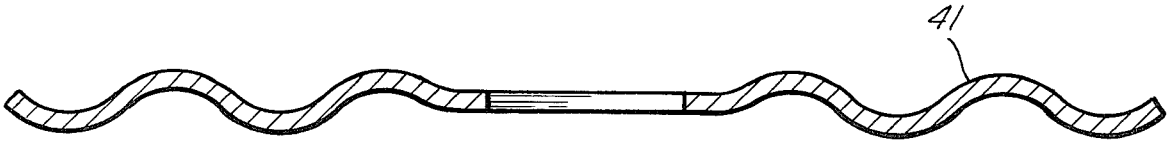
FIG. 5*a* is a section on line V*a* — V*a* of FIG. 5.
Figure 5B:
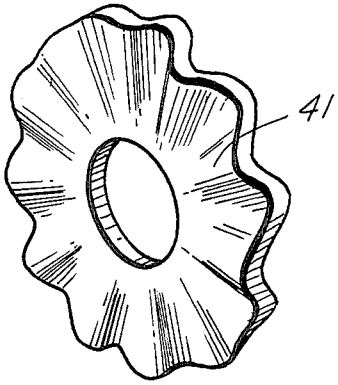
FIG. 5*b* is a perspective view showing one partition usable in the embodiment of FIG. 5.
Figure 5C:
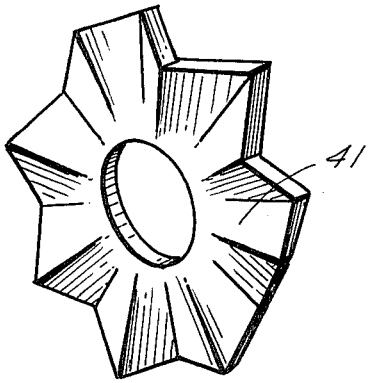
FIG. 5*c* is a view similar to FIG. 5*b* but showing a different partition.

FIGS. 4, 5 and 6, which have already been mentioned earlier, illustrate one example of the supply of printing medium. As shown in these three Figures in more detail, the inner free ends of the tubes 5 extend through openings in the wall of the inner tube 50 into chambers 151 formed in the circumferential wall of the (preferably synthetic plastic) spacing sleeve 51 where they are secured by means of nuts 251. The chambers 151 are separated from one another in axial direction by means of sealing rings or strips 351 — rings or strips may be used as desired and need not be circumferentially complete as long as they seal at the bottom region of the clearance, as shown — and these chambers 151 discharge the printing medium through openings 40 in the circumferential wall of the carrier 4 into the chambers 141 defined between the successive partitions 41. Since the inner tube 50 participates in the axial reciprocation of the carrier 4, but does not rotate, the position of chambers 141 relative to the respective opening 40 of carrier 4 does not change. Due to the rotation of carrier 4 the openings 40 keep moving into and out of communication with the associated chambers 141, in circumferential direction.

The axial reciprocation is effected in most of the embodiments in the manner shown in FIG. 7, namely by means of two crank drives 8 and 9. The crank drive 9 effects axial reciprocation of the printing screen 3 so that the latter performs an oscillating movement. For this purpose it reciprocates the complete unit composed of the end bearing units 20, 21 which are rigidly connected by the traverse members 22 and which unit moves on the wheels or the like 23 that travel on the rail sections 12. Depending upon the particular stroke being performed by the crank drive 9, this entire unit or carriages moves to the left and to the right, alternately. As illustrated, the crank drive 9 has a motor 90, a continuously variable gear drive 91 which is driven by the motor 90 and which in turn rotates an eccentric disc 92 the eccentricity of which is variable to vary the stroke, and two swing arms 93 and 94. The swing arm 94 is pivoted to the plate 221 of the end bearing unit 21 via a bolt 95. Opposite the crank drive 9 for the screen 3 there is located a crank drive 8 for effecting a similar reciprocation of the carrier 4. The crank drive 8 also has a motor 80, a continuously variable gear drive 81 which is driven by the motor 80 and in turn drives an eccentric disc 82 the eccentricity of which can be varied, and two swing arms 83 and 84 which are connected with one another. The upper end of the swing arm 84 is bifurcated and forms the arms **184*a* and 184*b*. These arms are connected via bolts or pins 85 with a ring 44 (compare FIG. 1) which surrounds the carrier 4, anti-friction bearings (not shown) being interposed between the carrier 4 and the ring 44. Both of the crank drives 8 and 9 are mounted on upright support 98 which in turn is secured centrally on a plate 89. Both crank drives can be adjusted as to the frequency and length and length of their strokes, and these adjustments can be carried out independently of the respective other crank drive so that an individually adjustable (both as to length and frequency of strokes) reciprocation can be obtained for the screen 3 as well as for the carrier 4**.

This means that if desired the screen 3 may be reciprocated alone, the carrier 4 may be reciprocated alone, or both the screen and the carrier may be reciprocated jointly. Also, they may be reciprocated in one and the same direction, in mutually opposite directions, or at different frequencies and different stroke lengths so as to overlap in their reciprocation. The adjustment in the length of stroke and of frequency of stroke can be carried out from zero to the maximum for each of the crank drives 8 and 9 individually by adjusting the eccentric radius of the eccentric discs 82 and 92,* respectively. It is evident, of course, that if it is only desired to be able to reciprocate the screen 3, the crank drive 8 can be omitted.

the adjusting being done by moving the eccents pins **82*a* and 92*a* in radial elongated holes of the discs 82 and 92 and clamping the pins in the desired position To be able to effect reciprocation of the screen 3 without undue friction between the screen 3 and the workpiece, and to avoid smearing and other disadvantageous consequences, the units 20 and 21 may be tiltably mounted. This is shown for the unit 21 in FIG. 7, where the equivalent unit 21' will be seen to have a lug L at which it is secured to its base plate 221 for pivoting about a substantially horizontal pivot 321 at one lateral side of the printing screen 3. At the opposite lateral side there is provided a screw-spindle unit 421 screwable in a lug secured to the unit 21' and reacting against the plate 221, thus being able to lift the unit 21' and the screen 3 upwardly of the plane of movement — and hence the upper surface of — the workpiece to a desired degree. The unit 20** is of course similarly mounted and provided.

FIG. 8 shows a further embodiment of the invention which illustrates that the invention can also be employed in a screen printing machine of the type having an endless belt-type screen **3*a* which is trained about three screen supporting rollers 30, 31 and 32 arranged at the corners of an imaginary triangle. In this embodiment is will be the opposite axial ends of the rollers 30, 31 and 32 which are journalled in the end bearing units 20' and 21' which are again connected by traverse members 22' to form a rigid unit and which are again movable on the rail sections 12 by means of the wheels or the like 23. The counter pressure beam 11 is present as before, and a printing blanket 14 travels above the counter pressure beam 11 and beneath the lower printing run of the screen 3*a*, the workpiece 13 travelling in the direction of the arrow intermediate the advancing printing blanket 14 (which also travels in the direction of the workpiece) and the printing screen 3*a*. A roller squeegee 38 of known construction may be employed which is located within the confines of the screen 3*a*** and squeezes printing medium through the same.

In FIG. 8 only the end bearing unit 20' is diagrammatically illustrated; the unit 21' is not visible. The units 20 and 21 may be again mounted for pivoting about horizontal pivots 321, by means of the spindles 421 as described with reference to FIG. 7. In this embodiment the axially spaced partitions **41*a* (only one shown) are simply planar partition walls which do not rotate as in the preceding embodiments but which are so shaped as to conform to the inner surface of the printing screen 3*a* at the lower printing run thereof — i.e. where it is juxtaposed with the workpiece 13 — and to the outer circumferential surfaces of the rollers 30, 31** and of the carrier 4. The entire unit can be axially reciprocated, but the carrier 4 does not rotate.

Figure 9:
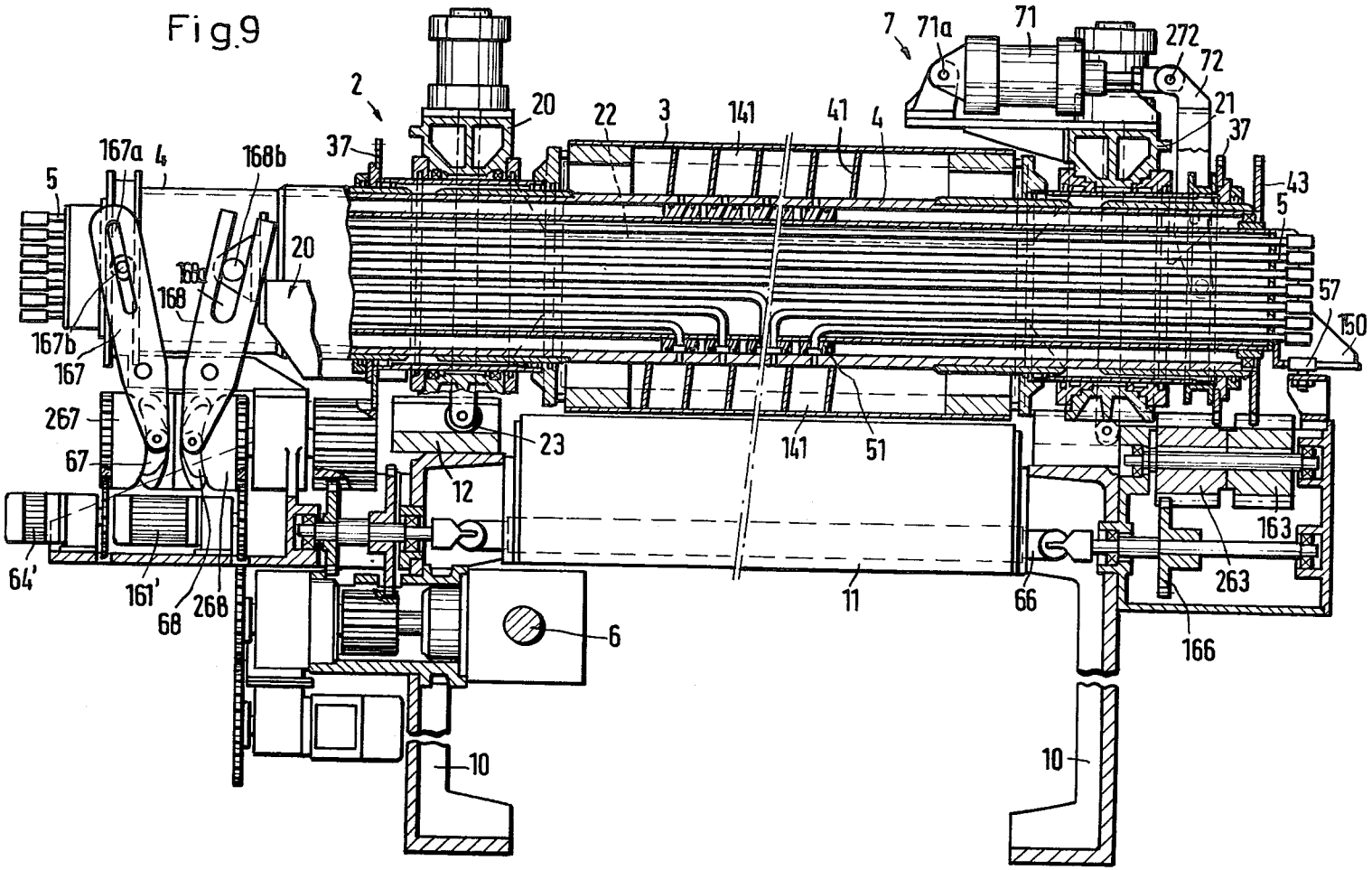
FIG. 9 is a view similar to FIG. 1 but illustrating still a further embodiment of the invention.

Still a further embodiment of the invention is illustrated in FIG. 9 which generally resembles the embodiment in FIG. 1 and wherein like elements are again identified like reference numerals. In the embodiment of FIG. 9 the crank drives 8 and 9 are replaced with other units as will be described, and a coupling shaft 66 is provided which replaces the shaft 265 shown in FIG. 3. The shaft 66 is located within the machine frame, instead of outside of it as is the shaft 265.

The crank drives 8 and 9 have been replaced in FIG. 9 by cam curves 67 and 68 which are engaged by roller followers provided on respective arms 167 and 168. The arm 167 has an axial slot 167*a* into which a pin 167*b* engages that is secured on the axially reciprocable carrier 4. Arm 168 is also provided with an axial slot 168*a* into which a pin 168*b* slidably extends which is provided on the end bearing unit 20. The units 20 and 21 are of course again connected by the traverse members 22 to form an axially reciprocable unit with one another and with the screen 3. The length of the axial strokes can be adjusted within a certain range in the embodiment of FIG. 9, whereas the frequency of reciprocation is predetermined by the shape of the cam curves or cam tracks 67, 68 and can be varied by replacing these tracks with other differently shaped ones. For this purpose the two drums 267, 268 on which the cam curves 67 and 68 are provided, can be replaced with drums having other curves. The drums 267, 268 are driven independently of one another at individually variable speed of rotation, by means of drive motors 64' and 161' via respectively associated variable gear drives.

Arm 167 effects axial reciprocation of the carrier 4 and arm 168 effects axial reciprocation of the unit which includes the printing screen 3. Torque is transmitted from the shaft 6 via the illustrated gearing to the left-hand end of the station, and is also transmitted to the right-hand end of the station via the illustrated shaft 66. Screen 3 and carrier 4 are driven via gears 166, 263 and 163.

It will be appreciated that the invention is susceptible of many modifications without departing in any way from the intent and scope of the invention. What is important is the possibility of axially reciprocating the screen 3 during the printing operation, and the fact that there is in effect produced a "carriage" by rigidly connecting the end bearing units 20 and 21 with one another via the traverse members 22 so that the unit can be reciprocated in toto. Other ways of effecting the reciprocation can be employed, for example cams can be used, or other devices. The possibility of pivoting the units 20, 21 about the pivots 321, and hence raising the screen 3 with reference to the working plane, is important. This makes it possible to adjust the contact — and pressure — between the screen and the workpiece very precisely and to so select it that during the reciprocation of the screen no smearing of the printed pattern on the workpiece will develop.

Figure 10:
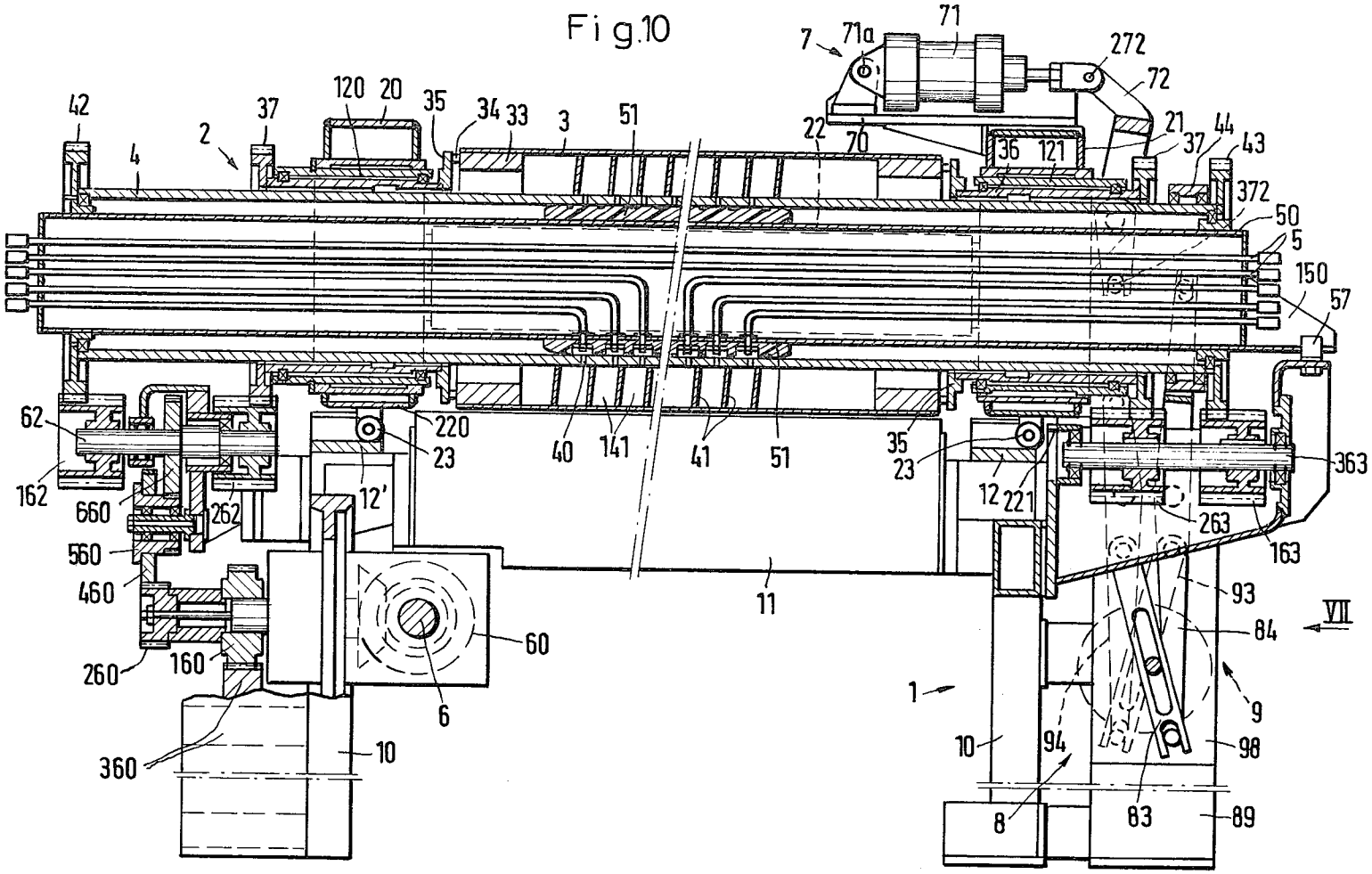
FIG. 10 is a view similar to FIG. 9, showing a further embodiment of a drive.

A further embodiment is illustrated in FIG. 10. Here, the speeds of rotation of screen 3 and carrier 4 are proportional to the speed of travel of the workpiece web through the machine, in accordance with a ratio that can be set for each operating instance.

The main shaft 6 again drives angle drive 60 and via the same, a gearing 360, and gears 160, 260, 460, 560 and 660, the shaft 62 on which the drive gears 162 and 262 for the carrier 4 and the screen are mounted. Gearing 360 is of the variable type, i.e. a variable gear transmission. Therefore, a change in the transmission ratio of gearing 360 changes the speed of rotation of the gears 162 and 262, and this change can be effected in accordance with the speed of travel of the workpiece, at a selectable ratio relative thereto. By varying the transmission ratio between gears 162, 262 and the gears 42 of carrier 4 and 37 of screen 3 (by exchanging respective gears for different ones) the speed ratio of rotation of screen and carrier can also be changed.

Figure 11:
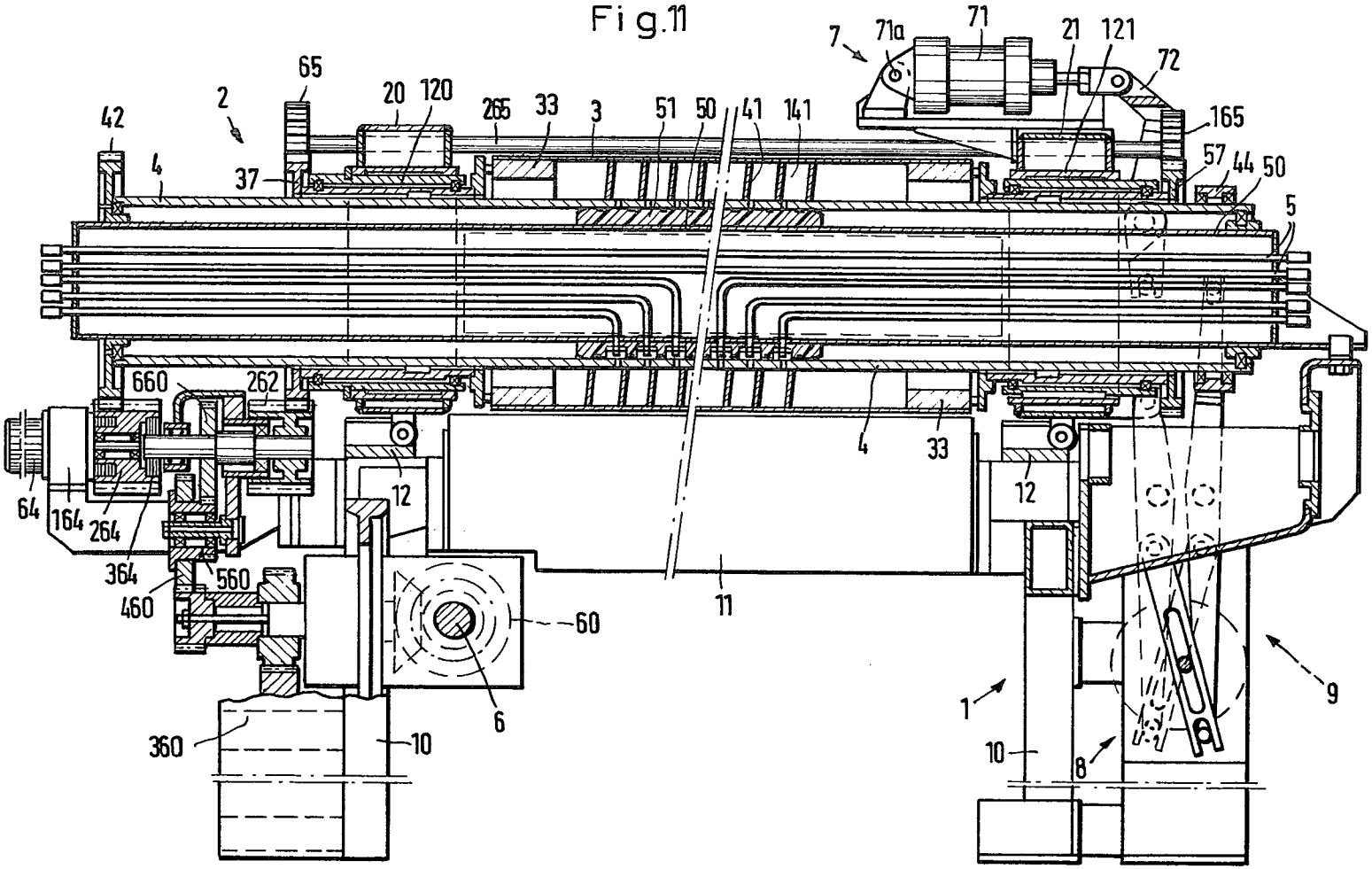
FIG. 11 is a view similar to FIG. 10, showing still another embodiment of a drive.
Figure 12:
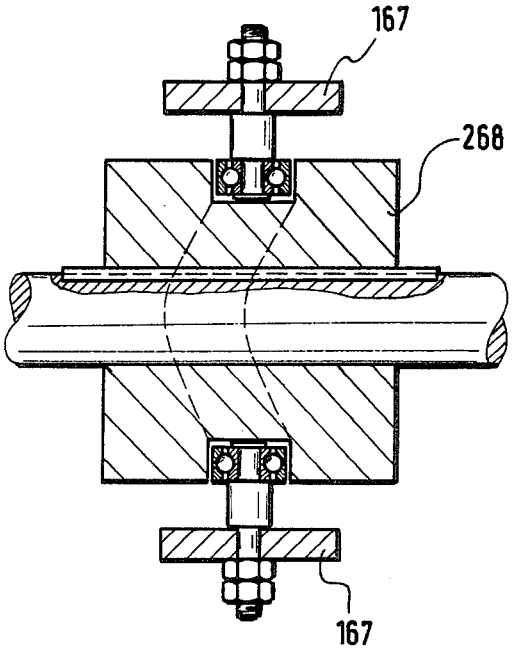
FIG. 12 is a drum similar to FIG. 9.

FIG. 11 shows still another embodiment wherein the drive is supplied from main drive shaft 6 to gearing 360 in the manner, and with the adjusting possibilities, as discussed relative to FIG. 10. The peripheral speed of the screen 3 may correspond, or not correspond, to the linear travel speed of the workpiece.

Carrier 4 is driven in rotation via the independently regulatable drive 164 with control motor 64, so that its rotational speed may be set at any desired ratio relative to the rotational speed of screen 3.

Torque transmission from one axial end of the annulus formed by the screen to the other axial end thereof, is again effected via shaft 265 and gears 65, 165, as described before. The transfer coupling 364, which makes it possible at will to couple the gear 264 for carrier 4 with either the unit 164 or the main drive shaft 6, makes it possible to selectively choose the rotational speed of carrier 4 to be either proportional to the travel speed of the workpiece or to make it independent thereof.

It will be understood that each of the elements described above, or two or more together, may also find a useful application in other types of constructions differing from the types described above.

While the invention has been illustrated and described as embodied in a screen printing machine, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a screen printing machine, a combination comprising an endless printing screen having an outer surface and a corresponding inner surface; means mounting said printing screen for advancement in a printing path in which successive portions of said outer surface become juxtaposed with a web travelling past said outer surface so as to print patterns onto said web; an elongated carrier extending through the space surrounded by said screen transversely of the path of travel of said web and defining with said inner surface an annular clearance; at least one partition on said carrier, extending across said clearance at least opposite said web and subdividing said clearance into two successive axial chambers; means for admitting flowable printing medium via said carrier into said chambers from where the printing medium passes through the screen so as to print on said web; and means for continuously reciprocating said screen in direction transversely of said printing path while said screen is advancing in said path, so that the location of successive patterns printed onto said web varies transversely of the web as a function of the reciprocation of said screen.

2. A combination as defined in claim 1, wherein said carrier is hollow and has a circumferential wall provided with openings for said printing medium which communicate with the respective chambers.

3. A combination as defined in claim 1, wherein said partition has an edge portion located and matingly contoured to said inner surface of said screen.

4. A combination as defined in claim 1; and further comprising means for rotating said carrier about a longitudinal axis thereof.

5. A combination as defined in claim 1; further comprising means for rotating said carrier about a longitudinal axis thereof, and wherein said partition is inclined to said axis at an angle other than 90°.

6. A combination as defined in claim 1, wherein said screen is generally annular, said mounting means comprising end bearing units journalling said screen at the ends of the annulus formed by said screen and traverse members connecting said units to form therewith a rigid aggregate.

7. A combination as defined in claim 6; further comprising a machine frame; and means reciprocably supporting said aggregate on said machine frame.

8. A combination as defined in claim 1; and means for adjusting the spacing between said web and said screen.

9. A combination as defined in claim 8, wherein said screen forms an annulus and said mounting means comprises end bearing units supporting said screen at the ends of said annulus, each of said units including a base plate and a housing connected to said base plate for pivoting about a substantially horizontal axis extending parallel to the longitudinal axis of said annulus, outside the space surrounded by said screen, at one side thereof; said adjusting means comprising spindle units each acting between one of said housings and the base plate thereof so as to tilt the housing relative to the base plate about said substantially horizontal axis.

10. A combination as defined in claim 1, said screen forming an annulus and said mounting means comprising respective end bearing units at the opposite ends of said annulus, and sleeves mounting said screen at said ends of said annulus in the respective end bearing unit; and means for tensioning said screen in direction transverse to the travel of said web.

11. A combination as defined in claim 10, wherein said tensioning means comprises a screen tensioning device carried by one of said end bearing units.

12. A combination as defined in claim 1; further comprising drive means for advancing said screen in said endless printing path, including a main drive shaft adjacent one end of the annulus formed by said screen, first means for transmitting torque to said screen at said one end, and second means for transmitting torque from said main drive shaft to said screen at the other end of said annulus.

13. A combination as defined in claim 12, wherein said second means comprises gears which respectively drive, and are driven in rotation by said carrier.

14. A combination as defined in claim 12, wherein said screen is tubular and said first means comprises a first pair of gears on opposite axial ends of said screen; and said second means comprises a second pair of gears each meshing with one of said gears of said first pair, and a shaft mounting said gears of said second pair for joint rotation.

15. A combination as defined in claim 12; wherein said first means and said second means comprise respective gears which are in mesh with one another, the gears of one of said first and second means having an axial length sufficient for them to remain in mesh with the gears of the other of said first and second means when said screen is being reciprocated.

16. A combination as defined in claim 1, said partition being a non-planar member having a free edge portion adjacent an inner surface of said screen.

17. A combination as defined in claim 16, wherein said member is a corrugated annular member.

18. A combination as defined in claim 1, wherein said carrier has a peripheral wall provided with rows of openings which communicate with said chambers.

19. In a screen printing machine, a combination comprising an endless printing screen having an outer surface and a corresponding inner surface; means mounting said printing screen for advancement in a path in which successive portions of said outer surface become juxtaposed with a web travelling past said outer surface; an elongated carrier extending through the space surrounded by said screen transversely of the path of travel of said web and defining with said inner surface an annular clearance; at least one partition on said carrier, extending across said clearance at least opposite said web and subdividing said clearance into two successive axial chambers; means for admitting flowable printing medium via said carrier into said chambers from where the printing medium passes through the screen so as to print on said web; and means for reciprocating said screen and said carrier jointly in direction transversely of said path of travel of said web.

20. In a screen printing machine, a combination comprising an endless printing screen having an outer surface and a corresponding inner surface; means mounting said printing screen for advancement in a path in which successive portions of said outer surface become juxtaposed with a web travelling past said outer surface; an elongated carrier extending through the space surrounded by said screen transversely of the path of travel of said web and defining with said inner surface an annular clearance; at least one partition on said carrier, extending across said clearance at least opposite said web and subdividing said clearance into two successive axial chambers; means for admitting flowable printing medium via said carrier into said chambers from where the printing medium passes through the screen so as to print on said web; first reciprocating means for reciprocating said screen in direction transversely of said path of travel of said web; and second reciprocating means for reciprocating said carrier also in said direction.

21. A combination as defined in claim 20, wherein said second reciprocating means is independent of said first reciprocating means.

22. A combination as defined in claim 21; further comprising first drive means for advancing said screen in said path; and second drive means for rotating said carrier about a longitudinal axis thereof.

23. A combination as defined in claim 22; wherein said first and second drive means and said reciprocating means are respective units each independent of the other units and each continuously variable.

24. A combination as defined in claim 22; further comprising means for adjusting said second drive means and said first reciprocating means for operation proportionally to the speed of travel of said web in said path.

25. In a screen printing machine, a combination comprising an endless generally annular printing screen having an outer surface and a corresponding inner surface; means mounting said printing screen for advancement in a path in which successive portions of said outer surface become juxtaposed with a web travelling past said outer surface including end bearing units journalling said screen at the ends of the annulus formed by said screen and traverse members connecting said units to form therewith a rigid aggregate; means for reciprocating said aggregate in direction transverse of the travel of said web; an elongated hollow carrier rotatable about its longitudinal axis extending through the space surrounded by said screen transversely of the path of travel of said web and defining with said inner surface an annular clearance; a nonrotatable inner tube extending through said carrier; means for reciprocating said carrier and inner tube in said transverse direction; at least one partition on said carrier, extending across said clearance at least opposite said web and subdividing said clearance into two successive axial chambers; and means for admitting flowable printing medium via said carrier into said chambers from where the printing medium passes through the screen so as to print on said web.

26. A combination as defined in claim 25, said inner tube having an axial slot; and further comprising a stationary anti-rotation projection extending into said slot for preventing said inner tube from rotating.

27. A combination as defined in claim 26, said inner tube defining an annular space with said carrier; further comprising a spacing sleeve in said annular space and having a peripheral wall provided with compartments which communicate with said chambers; printing-medium supply tubes in said inner sleeve and having inner ends communicating with said compartments and outer ends accessible at at least one axial end of said inner tube; flexible supply conduits, one for each of said tubes; quick-release couplings for coupling said conduits to said tubes; and means for supplying printing medium to said supply conduits, comprising a plurality of pumps each communicating with one of said supply conduits.

28. In a screen printing machine, a combination comprising an endless screen forming an annulus and having an outer surface and a corresponding inner surface; means mounting said printing screen for advancement in a path in which successive portions of said outer surface become juxtaposed with a web travelling past said outer surface including end mounting units at the opposite ends of said annulus, and traverse members rigidly connecting said end mounting units to form with the same and with said screen an aggregate; an elongated carrier extending through the space surrounded by said screen transversely of the path of travel of said web and defining with said inner surface an annular clearance; means for reciprocating said aggregate and said carrier, each in direction transversely of said path of travel of said web, said reciprocating means including respective swing-arm drives; at least one partition on said carrier, extending across said clearance at least opposite said web and subdividing said clearance into two successive axial chambers; and means for admitting flowable printing medium via said carrier into said chambers from where the printing medium passes through the screen so as to print on said web.

29. In a screen printing machine, a combination comprising an endless printing screen forming an annulus and having an outer surface and a corresponding inner surface; means mounting said printing screen for advancement in a path in which successive portions of said outer surface become juxtaposed with a web travelling past said outer surface including end mounting units at the opposite ends of said annulus, and traverse members rigidly connecting said end mounting units to form with the same and with said screen an aggregate; an elongated carrier extending through the space surrounded by said screen transversely of the path of travel of said web and defining with said inner surface an annular clearance; at least one partition on said carrier, extending across said clearance at least opposite said web and subdividing said clearance into two successive axial chambers; means for admitting flowable printing medium via said carrier into said chambers from where the printing medium passes through the screen so as to print on said web; and means for reciprocating said aggregate and said carrier, each in direction transversely of said path of travel of said web, said reciprocating means including respective cam drives each having a rotatable drum formed with a cam track, a swing-arm provided with a cam follower and connected to said aggregate and carrier, respectively, and means for continuously varying the rotational speed of the drum.

30. In a screen printing machine, a combination comprising an endless printing screen having an outer surface and a corresponding inner surface; means mounting said printing screen for advancement in a path in which successive portions of said outer surface become juxtaposed with a web travelling past said outer surface; an elongated carrier extending through the space surrounded by said screen transversely of the path of travel of said web and defining with said inner surface an annular clearance; at least one partition on said carrier, extending across said clearance at least opposite said web and subdividing said clearance into two successive axial chambers; means for admitting flowable printing medium via said carrier into said chambers from where the printing medium passes through the screen so as to print on said web; means for rotating said carrier about its longitudinal axis; and means independent of said rotating means for reciprocating said carrier lengthwise of said longitudinal axis.

31. In a screen printing machine, a combination comprising an endless printing screen having an outer surface and a corresponding inner surface; means mounting said printing screen for advancement in a path in which successive portions of said outer surface become juxtaposed with a web travelling past said outer surface; an elongated carrier having a longitudinal axis and two spaced ends, said carrier extending through the space surrounded by said screen transversely of the path of travel of said web and defining with said inner surface an annular clearance; at least one partition on said carrier, extending across said clearance at least opposite said web and subdividing said clearance into two successive axial chambers; means for admitting flowable printing medium via said carrier into said chambers from where the printing medium passes through the screen so as to print on said web; and means for reciprocating said carrier lengthwise of said axis, including a swing-arm drive, and a ring connected to one of said ends and to said swing-arm drive.

32. In a screen printing machine, a combination comprising an endless printing screen having an outer surface and a corresponding inner surface; means mounting said printing screen for advancement in a path in which successive portions of said outer surface become juxtaposed with a web travelling past said outer surface; an elongated hollow rotatable carrier extending through the space surrounded by said screen transversely of the path of travel of said web and defining with said inner surface an annular clearance; at least one partition on said carrier, extending across said clearance at least opposite said web and subdividing said clearance into two successive axial chambers; means for admitting flowable printing medium via said carrier into said chambers from where the printing medium passes through the screen so as to print on said web; a non-rotatable inner tube extending with annular clearance through said carrier; and a spacing sleeve in said clearance between said carrier and said inner tube and having a peripheral wall provided with a plurality of compartments each communicating with one of said chambers and with the interior of said carrier through openings in the latter.

33. A combination as defined in claim 32, and further comprising sealing means sealing said compartments against communication with one another.

* * * * *